US006367182B1

(12) United States Patent
Olson, Jr.

(10) Patent No.: US 6,367,182 B1
(45) Date of Patent: Apr. 9, 2002

(54) FLEXIBLE TEMPORARY LICENSE DEVICE

(76) Inventor: Robert L. Olson, Jr., 29 Alice La., Lake Barrington, IL (US) 60010

( * ) Notice: Subject to any disclaimer, the term of this patent is extended or adjusted under 35 U.S.C. 154(b) by 0 days.

(21) Appl. No.: 09/352,650

(22) Filed: Jun. 30, 1999

(51) Int. Cl.[7] ..... G09F 21/04

(52) U.S. Cl. ..... 40/593; 40/591; 40/597; 40/643; 40/644; 40/661

(58) Field of Search ..... 40/591, 593, 597, 40/643, 644, 651, 661; 248/205.5, 206.3

(56) References Cited

U.S. PATENT DOCUMENTS

| | | | | | |
|---|---|---|---|---|---|
| 1,645,229 | A | * | 10/1927 | Churmusi | 40/653 |
| 1,683,645 | A | * | 9/1928 | Abbey | 40/651 |
| 1,729,872 | A | * | 10/1929 | Hauge | 40/643 |
| 1,840,763 | A | | 1/1932 | Benchley | |
| 1,883,791 | A | * | 10/1932 | Jewell | 40/597 |
| 3,338,293 | A | * | 8/1967 | Hohmann | 160/370.21 |
| 3,531,880 | A | * | 10/1970 | Ramee | 40/643 |
| 4,184,276 | A | | 1/1980 | Hernandez | |
| 4,953,315 | A | | 9/1990 | Romaine | |
| 5,087,005 | A | * | 2/1992 | Holoff et al. | 248/205.8 |
| 5,099,594 | A | | 3/1992 | Reas et al. | |
| 5,131,177 | A | * | 7/1992 | Sy, Jr. | 40/593 |
| 5,141,191 | A | | 8/1992 | Coffield | |
| 5,162,696 | A | * | 11/1992 | Goodrich | 313/511 |
| 5,235,768 | A | | 8/1993 | Eder | |
| 5,266,144 | A | | 11/1993 | Gaeto, Jr. | |
| 5,386,960 | A | | 2/1995 | O'Brien | |
| 5,800,018 | A | * | 9/1998 | Colombo et al. | 297/395 |

* cited by examiner

*Primary Examiner*—B. Dayoan
*Assistant Examiner*—Andrea Chop
(74) *Attorney, Agent, or Firm*—Meroni & Meroni, P.C.; Charles F. Meroni, Jr.; Paul D. Pressley

(57) ABSTRACT

A temporary license device configured for removable mounting to an interior surface of a vehicle window includes an elongated generally rectangular plate formed of transparent plastic material. The plate is flexible to conform to a curvature of the vehicle window and has a memory characteristic enabling the plate to return to its original shape after being mounted. Each side of the plate has a protective sheet removably attached thereto to prevent damage to the plate prior to mounting. The plate and protective sheets have a plurality of apertures extending therethrough. A plurality of suction cups are removably connected to the plate to mount the plate to the vehicle window.

3 Claims, 3 Drawing Sheets

FLEXIBLE TEMPORARY LICENSE DEVICE

BACKGROUND OF THE INVENTION

1. Field of the Invention

The present invention relates generally to temporary license and registration holders and the like. More particularly, the invention pertains to a new and improved flexible device for holding temporary licenses that is adapted to be affixed to the windshield of a motor vehicle.

2. Description of the Prior Art

Temporary licenses provided by various motor vehicle departments, automobile agencies, as well as city parking stickers, state park and recreation stickers, and other similar registrations are typically provided with adhesive backings to allow them to be affixed to the inside surface of a windshield. Once affixed, these licenses or registrations are not removable without tearing or destroying the license or registration in the process. Further, once expired, these self-adhesive licenses or registrations can be difficult to remove, especially when placed in a lower inside comer of a windshield where a vehicle's dashboard often restricts a user's access.

Various prior art temporary license devices or holders are known in the art to provide a removable means of displaying such licenses or registrations. However, it has been found that the rigid nature of many such devices makes them unsuitable for use with vehicles having curved windshields. Others still have been found to be overly complex in design or prone to damage or scratches prior to installation, all of which detracts from the aesthetic appearance of the device.

As will be described in greater detail hereinafter, the device differs from those previously proposed and employs a number of novel features that render it highly advantageous over the prior art.

SUMMARY OF THE INVENTION

Accordingly, it is an object of this invention to provide an improved temporary license device that can be removably mounted to an inside surface of a vehicle window.

Another object of this invention is to provide a temporary license device that is flexible and can conform to the curvature of a vehicle window and return to its original shape after being removed therefrom.

Still another object of this invention is to provide a temporary license device that can be packaged and transported without causing damage or scratches to the transparent plate of the device so that a user may assemble the device with the plate being in pristine condition.

To achieve the foregoing and other objectives, and in accordance with the purposes of the present invention temporary license device is provided for removably mounting to an interior surface of a vehicle window. The device includes an elongated generally rectangular plate formed of transparent plastic material. The plate is flexible to to conform a curvature of the vehicle window and has a memory characteristic enabling the plate to return to its original shape after being mounted. Each side of the plate has a protective sheet removably attached thereto to prevent damage to the plate prior to mounting to the vehicle window. The plate and protective sheets have a plurality of apertures extending therethrough. Each aperture extends through the plate and protective sheets of the front and back sides in co-axial alignment therewith. A plurality of suction cups are provided to removably mount the plate to the vehicle window. Each suction cup has a neck portion and a cup portion. The neck portion is sized for extending through one of the apertures in the plate for removable engagement therewith.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
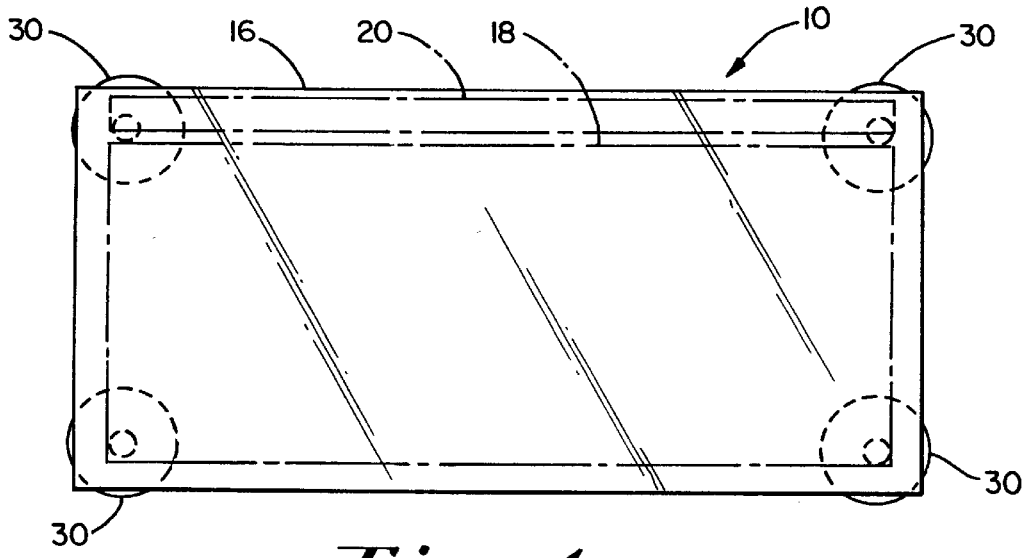
FIG. 1 is a top plan view of the present invention.
Figure 2:
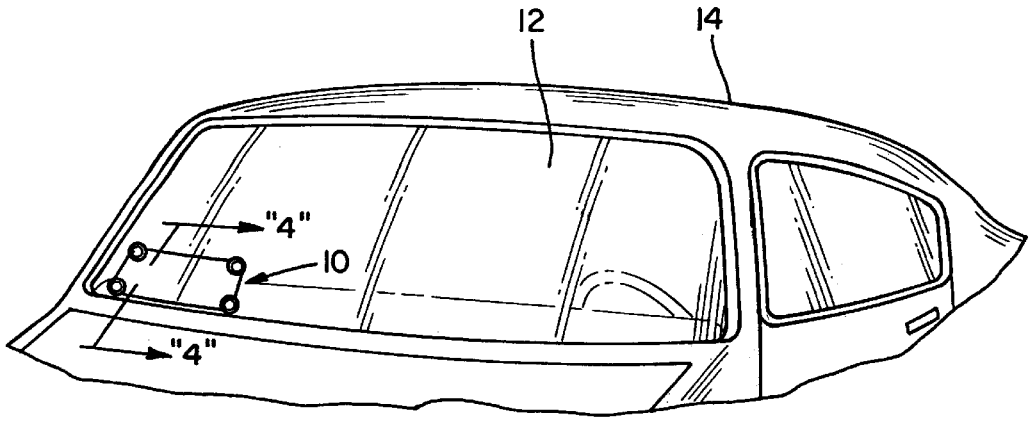
FIG. 2 is a perspective view of the present invention mounted to a windshield of a vehicle.

Referring now to the drawings, knock-down temporary license device or license holder device or kit 10 in its assembled form is illustrated in FIG. 1. The device 10 is adapted for use with an interior surface of a vehicle window or windshield 12 of vehicle 14, as shown in FIG. 2.

The device 10 includes elongated generally rectangular plate 16 formed of thin transparent plastic material. In a preferred embodiment, the plate 16 is formed of acrylic plastic and has a thickness of approximately ⅛ inch. Where the plate is used for particular licenses, the plate will be sized accordingly. For typical temporary licenses, for example, a size of 4½" by 11" inches will provide suitable space for the temporary license 18, as well as advertising indicia 20, if desired, as shown in FIG. 1.

Figure 5:
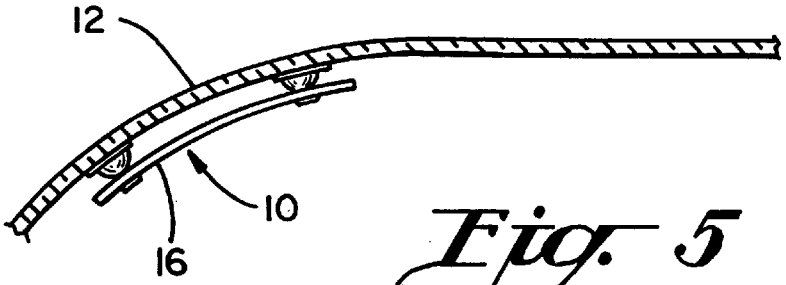
FIG. 5 is a diagrammatical view of the prevent invention in a curved configuration with a curved portion of a vehicle windshield.
Figure 6:
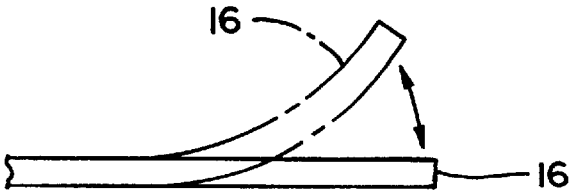
FIG. 6 is a partial side view of the plate of the present invention.
Figure 7:
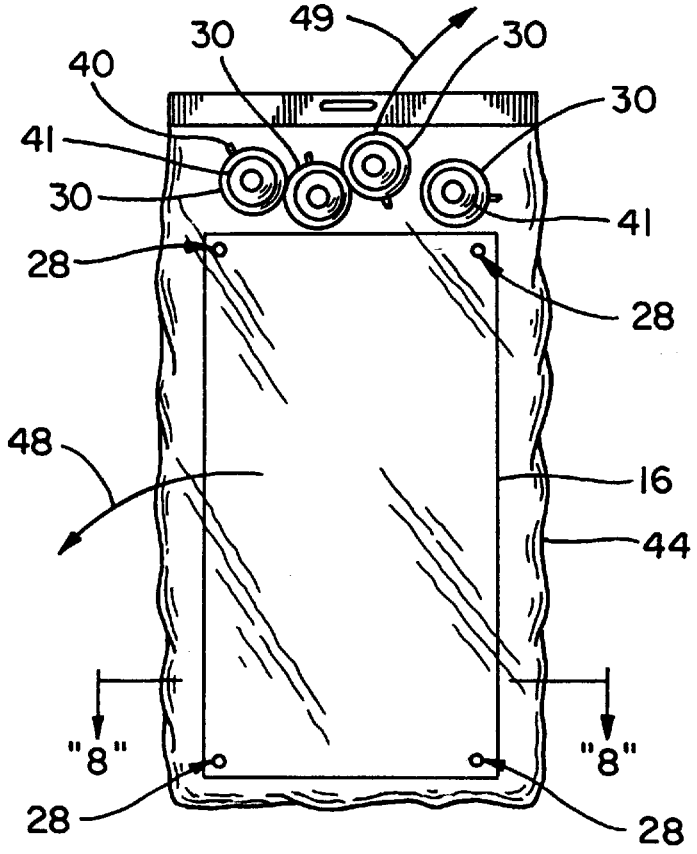
FIG. 7 is a top plan view of the present invention in a disassembled packaged state.
Figure 8:
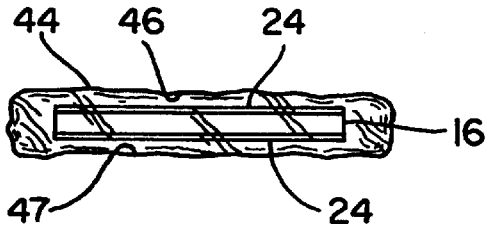
FIG. 8 is a sectional view taken along line 8—8 of FIG. 7.
Figure 9:
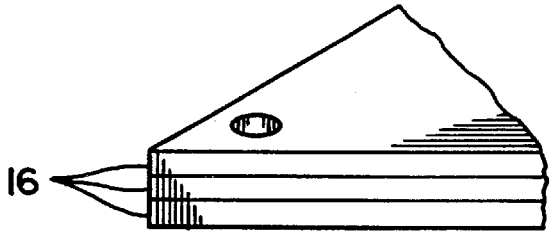
FIG. 9 is a partial perspective view of a stack of plates of the present invention.

The plate 16 is flexible to allow the plate to conform or bend to a curvature of the vehicle window 12, as illustrated diagrammatically in FIG. 5. The plate 16 has a memory characteristic enabling the plate 16 to return to its original shape after being mounted in a curved configuration for a period of time, as illustrated in FIG. 6.

Figure 3:
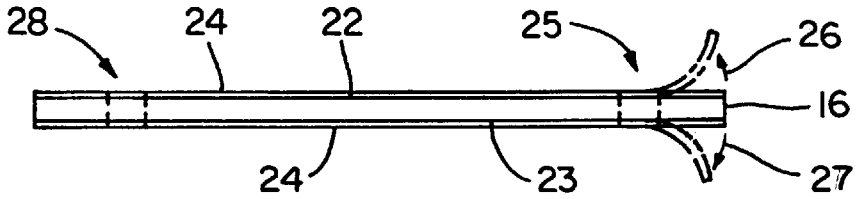
FIG. 3 is an enlarged end view of the present invention.

Referring to FIG. 3, the plate 16 has front and back sides 22, 23 parallel with one another. Each side 22, 23 has a protective sheet 24 removably attached thereto to prevent damage to the plate 16 prior to mounting to the vehicle window 12. In a preferred embodiment, the protective sheets 24 are formed of paper having an adhesive side allowing the sheet 24 to adhere to the respective side of the plate 16 until peeled off, as illustrated in FIG. 3 by arrows 26, 27. The plate 16 and protective sheets 24 have a plurality of apertures 28 extending therethrough. Each aperture 28 extends through the plate 16 and protective sheets 24 of the front and back sides 22, 23 in co-axial alignment therewith.

Figure 4:
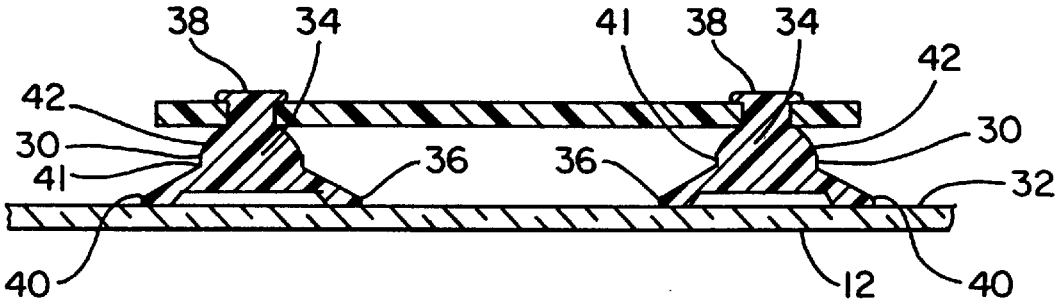
FIG. 4 is a sectional view taken along line 4—4 of FIG. 2.

Referring to FIG. 4, suction cups 30 are provided and removably attached to the plate 16 for removable mounting of the plate 16 to the interior surface 32 of the vehicle window 12. Each suction cup 30 has a neck portion 34 and a cup portion 36. The neck portion 34 has an enlarged head 38 that is slightly larger in diameter than the aperture 28, but is flexible to allow the head 38 to be pressed through the aperture 28 from one side to the other with the neck portion 34 being sized for extending through the aperture 28 in the plate 16 to removably engage suction cup 30 with the plate 16 after the protective sheets 24 are removed.

In a preferred embodiment, the suction cups 30 are transparent and formed of a ultraviolet resistant polyvinyl chloride compound to prevent deterioration from the sun, including cracking and discoloration, and to provide reliability across thermal extremes of −22 degrees Fahrenheit to 120 degrees Fahrenheit. To aid in the removal of the device 10 from the window 12, the cup portion 36 of each suction cup 30 has a release tab 40 extending therefrom allowing a user to pull the tab 40 to disengage the cup 30 from the window. The cup portion 36 preferably has an annular flange 41 extending about an outer side 42 of the cup portion 36 for diffusing light passing through the suction cup 30 to prevent light from being concentrated and forming a hot focal point in the vehicle's interior which could damage nearby plastics or paint.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. In combination, a temporary license holder device for removably mounting to an interior curved surface of a vehicle window and a temporary license form, the holder device comprising:

a plate sized and shaped for receiving a temporary license form, the plate formed of flexible transparent plastic material to allow the plate to conform to a curvature of the vehicle window having a memory characteristic enabling the plate to return to its original shape after being mounted in a curved configuration making the plate adaptable for reuse, the plate having front and back sides, each side having a protective sheet removably attached thereto to prevent damage to the plate prior to mounting to the vehicle window, the plate and protective sheets having a plurality of apertures extending therethrough, the plurality of apertures extending through the protective sheets being in co-axial alignment with the plurality of apertures extending through the plate; and mounting means removably attached to the plate for removably mounting the plate to the interior surface of the vehicle window, the mounting means including a plurality of suction cups, the suction cups when engaged on the interior curved surface of the vehicle window are adapted to cause the plate to flex to conform to the curvature of the interior curved surface of the vehicle window, each suction cup having a neck portion and a cup portion, each neck portion being sized for extending through one of said plurality of apertures in the plate for removable engagement therewith, the temporary license form having a front side and a back side, one side of the temporary license form having an adhesive backing affixing the temporary license form to the plate.

2. The combination of claim 1, wherein the suction cups are formed of ultraviolet resistant polyvinyl chloride compound to prevent deterioration.

3. The combination of claim 1, wherein the cup portion of each suction cup has an annular flange extending about an outer side of the cup portion of each suction cup for diffusing light passing through each suction cup.

* * * * *